US008668105B2

(12) United States Patent
Al-Subaiey

(10) Patent No.: US 8,668,105 B2
(45) Date of Patent: Mar. 11, 2014

(54) BUOYANT PLUG FOR EMERGENCY DRAIN IN FLOATING ROOF TANK

(75) Inventor: Nassir S. Al-Subaiey, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 298 days.

(21) Appl. No.: 12/970,489

(22) Filed: Dec. 16, 2010

(65) Prior Publication Data

US 2012/0152950 A1 Jun. 21, 2012

(51) Int. Cl.
*B65D 88/38* (2006.01)

(52) U.S. Cl.
USPC ..... 220/219; 220/216; 4/398; 137/172; 52/3

(58) Field of Classification Search
USPC ..... 220/219; 137/172; 4/398; 52/3
See application file for complete search history.

(56) References Cited

U.S. PATENT DOCUMENTS 2,560,586 A * 7/1951 Michaels ..... 220/219
3,647,113 A 3/1972 Belleli
4,936,338 A 6/1990 Fonoimoana
5,758,792 A 6/1998 Jolly
5,829,621 A 11/1998 Laverman
2002/0195449 A1* 12/2002 Johnson et al. ..... 220/216
2009/0212051 A1* 8/2009 Liu ..... 220/23.83

OTHER PUBLICATIONS

International Search Report and Written Opinion of the International Searching Authority, Apr. 9, 2012.

* cited by examiner

*Primary Examiner* — Anthony Stashick
*Assistant Examiner* — Elizabeth Volz
(74) *Attorney, Agent, or Firm* — Abelman, Frayne & Schwab

(57) ABSTRACT

A floating plug emergency drain valve for a floating roof used with a storage tank for volatile fluid, where the floating roof includes vertically spaced apart top and bottom surfaces and a duct having open top and bottom ends that extends through the roof for drainage through the roof of water accumulated atop the roof, the valve having an open state for allowing the accumulated water to drain downward through the duct and a closed state for blocking vapors from rising upward through the duct, the valve including a valve seat having an upper sealing surface, and a valve sealing element having a buoyant ball-like upper part, and a bottom part formed as a plug extending downward with a bottom sealing surface sealing with the valve seat upper sealing surface when the valve is in its closed state.

16 Claims, 3 Drawing Sheets

Figure 4:
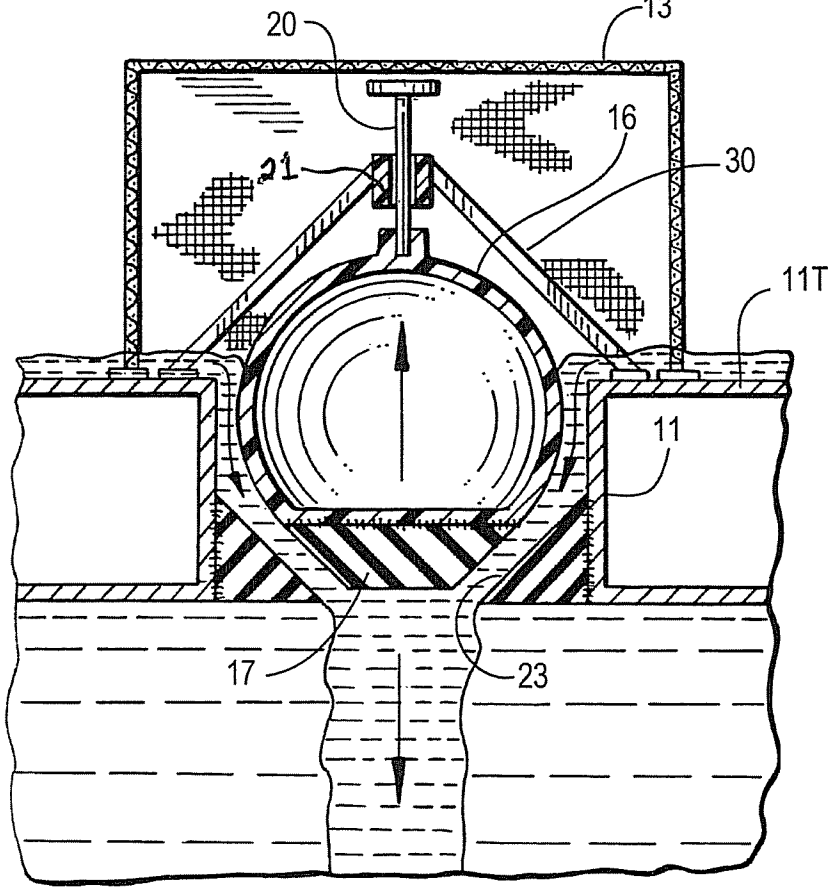

FIG. 1
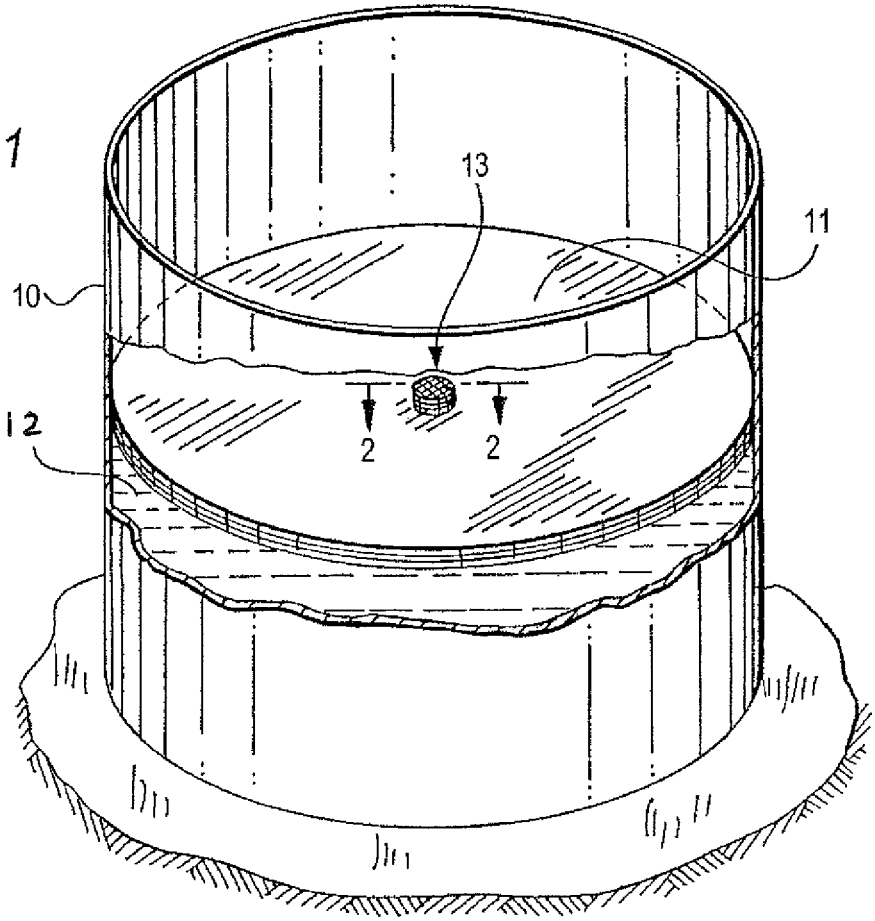
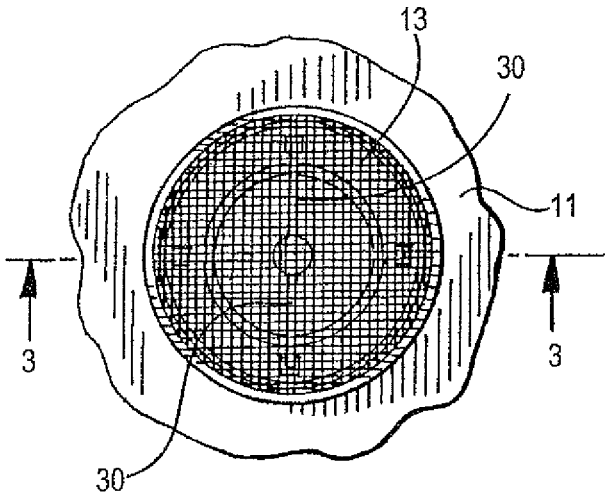
FIG. 2

BUOYANT PLUG FOR EMERGENCY DRAIN IN FLOATING ROOF TANK

I. FIELD OF THE INVENTION

This invention is in the field of floating roofs for storage tanks that contain volatile fluid, and particularly for an emergency drain valve for water accumulated atop a double deck roof.

II. BACKGROUND OF THE INVENTION

Storage tanks for oil and other liquid petrochemical products are typically provided with floating roofs that float atop the liquid product and seal the upper portions of the tanks to prevent the escape of harmful vapors off the surface of the contained liquid. Additional seals are provided between the outer periphery of each floating roof and the inner wall of the tank.

Such floating roofs are usually circular in shape, light weight and buoyant, typically may have a diameter of fifty feet or more, and are relatively thin and relatively weak.

A serious potential problem or danger with such floating roofs is that under rainstorm conditions water may accumulate on top of the roof and cause it to sink or break. Under these circumstances vapor from the liquid below the roof could escape into the atmosphere or into the space in the tank but above the roof, and produce undesirable and/or dangerous conditions.

In the prior art there are numerous drainage systems for such accumulated water atop a floating roof, and also emergency drainage systems which are intended to drain automatically whenever the accumulated water reaches a pre-determined dangerous level.

Disadvantages of prior art drainage systems include unreliable valves which stick in a closed or open position, and valves which are expensive or difficult to maintain, repair or install. With such prior art valves the sealing element may not reliably respond to a flow of accumulated water on the roof, or is too slow in reaction time to open the drain.

Prior art patent U.S. Pat. No. 5,758,792 discloses, for example, in FIG. 30 a floating ball check valve 220 on a floating roof where the plane of the closure is at the top surface of the roofs top deck sheeting 24. With this arrangement the ball 236 will not rise and open the valve until a substantial amount of water has accumulated upon the roof. During drainage, another feature of this device is that the ball will float down and close while a certain quantity of water still remains on the roof. Thus, this valve's main purpose is to block upward flow of vapors after the main drainage of water has occurred; it does not address the problem of massive accumulation of water before the valve opens or the problem of water remaining on the roof after the valve has closed.

III. OBJECTS AND SUMMARY OF THE PRESENT INVENTION

The new invention is a floating plug emergency drain system for a floating roof, which typically has a double deck structure of top and bottom spaced apart surfaces with an aperture extending vertically through the roof to provide a drainage duct for water accumulated on the roof. This emergency drain system includes a valve element with a bottom part formed as a plug portion having a truncated conical shape that will drop into and seal with a mating corresponding conical shape valve seat, and an upper part which is a buoyant ball-like element. Extending further upward from the top of the ball-like element is guide pole generally coaxial with the central axis of the ball-like element and the truncated conical plug portion. This guide poll extends upward into a guide member which typically is a sleeve surrounding said guide poll, said guide element assuring that the guide poll will move accurately, vertically and keep the valve element's plug part properly aligned with the valve seat so that sealing is achieved quickly and reliably. The valve element has an overall weight which assures its descent to the valve seat at all times that water is not surrounding the buoyant ball-like part; the weight is small enough so that this part will float upward and unseat the plug part whenever a small amount of water flows into the sump area in the top of the roof.

In a preferred embodiment of this invention the ball element is positioned in the drain duct or drain shaft at an elevation lower than the top of the floating roof deck. Consequently, water beginning to accumulate on the top of the roof will flow into said drain duct and immediately cause the ball to float upward, opening the valve. Thus, draining will begin very quickly and before any significant quantity of water has accumulated on the roof. Obviously, the valve will remain open as long as water continues to flow downward from the roof.

In the preferred embodiment illustrated herein the drain duct extending through the roof has vertical length similar to the height of the ball element; however, the significance, as mentioned above, is that the elevation of the closure and valve seat is lower than the top surface of the floating roof where water begins to accumulate, and in this embodiment the valve seat is at the bottom of a sump in the roofs upper surface. Alternatively, said closure might be closer or farther from, but still below the top surface.

The drain duct extending from the top of the floating roof to the bottom may be a duct provided in the roof's structure or may be a cylindrical tube positioned to pass through the roof. In either case, such duct is a chamber in which said sealing element moves and through which accumulated water flows. The top and bottom ends of the duct are open obviously to allow accumulated water to flow into, through and out the bottom thereof. The top of the open duct is protected from debris by a screen element that generally overlies the entire open end. Such a screen may be formed generally as an upward extending hemisphere or other curved surface or other shape that may extend upward to accommodate the guide pole or may have an aperture through which the guide pole extends.

Finally, the guide element is situated above the top surface of the roof and obviously directly above the guide pole of the sealing element. This guide element is supported by and secured to the roof, preferably by support legs extending upward from the roof's top surface. Such support legs may conveniently be combined with the screen to support both the guide element and the screen, or to at least cooperate with the screen. The screen is preferably a non-rusting mesh which allows accumulated water to freely flow through it, but blocks debris which could interfere with the sealing surfaces of the plug and valve seat, or which would be undesirable if it flowed into the stored liquid below.

The foregoing and other objects, features and advantages of the invention will be apparent from the following more particular description of a preferred embodiment of the invention, as illustrated in the accompanying drawings.

IV. BRIEF DESCRIPTION OF THE DRAWINGS

Figure 3:
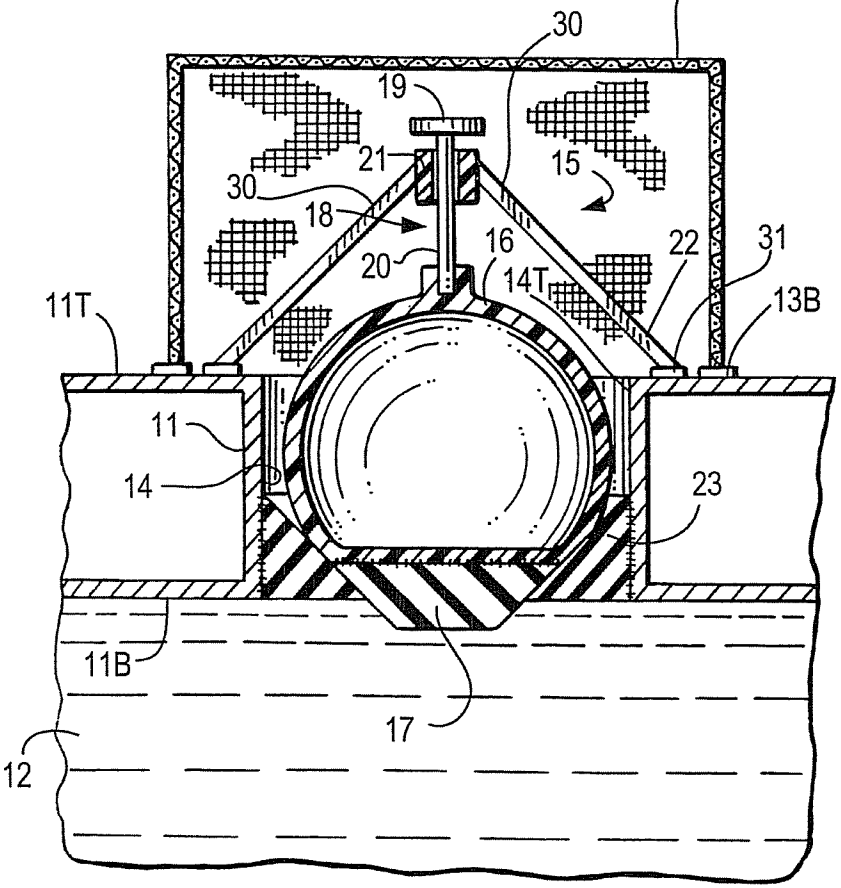
Figure 5:
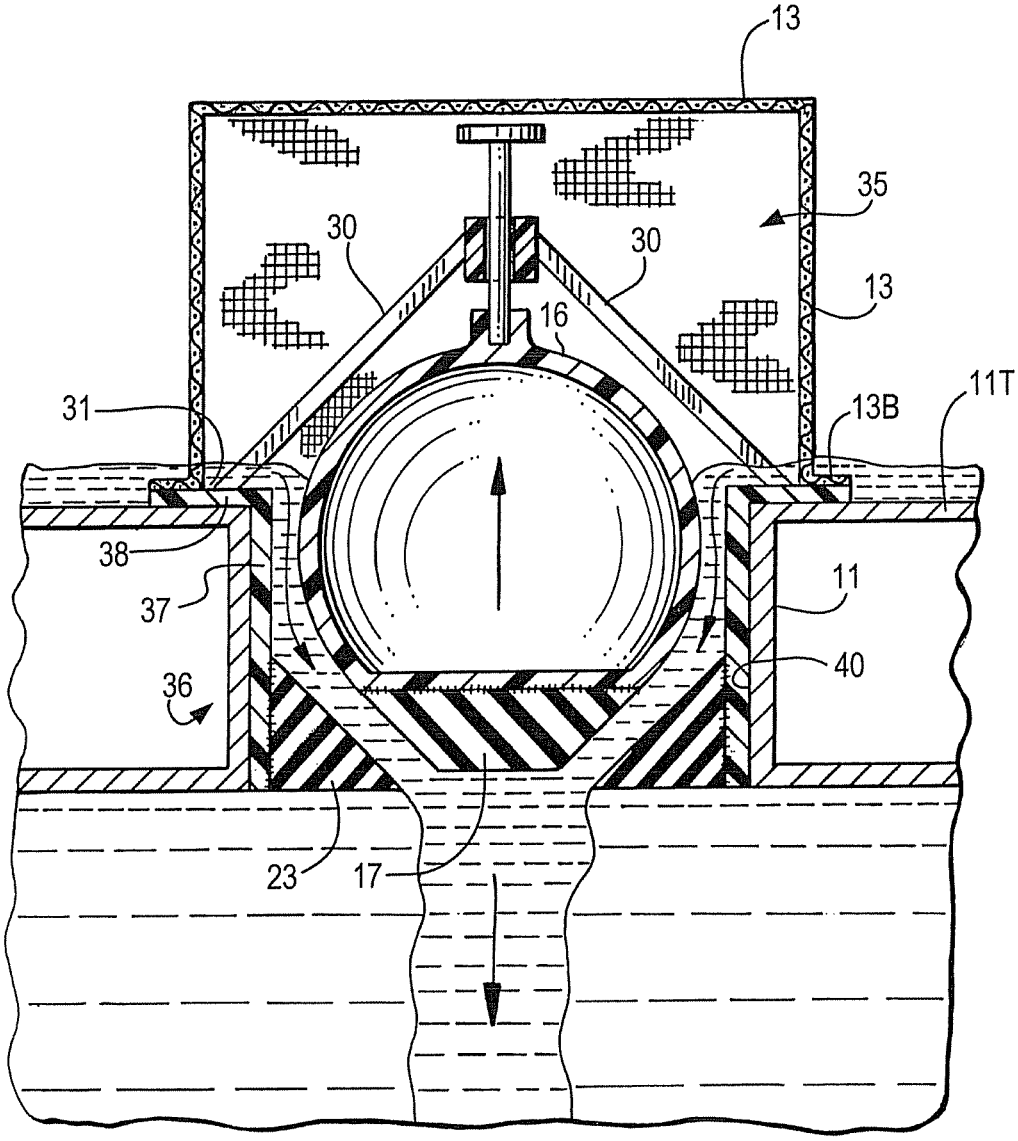

FIG. 1 is a top front perspective view of a floating roof storage tank with the new floating plug emergency drain, FIG. 2 is an enlarged fragmentary top plan view of the floating roof, FIG. 3 is a fragmentary elevation view in section taken along lines 3-3 of FIG. 2 showing the new floating plug emergency drain in its closed state in the floating roof, FIG. 4 is a view similar to that of FIG. 3 showing the floating plug emergency drain in its open state, and FIG. 5 is a view similar to that of FIG. 4 showing a second embodiment of the new floating plug emergency drain.

V. DETAILED DESCRIPTION OF THE PREFERRED EMBODIMENTS

For convenience and clarity in describing these embodiments, similar elements or components appearing in different figures will have the same reference numbers.

FIGS. 1-4 illustrate a typical storage tank 10 with a floating roof 11 for containing volatile liquid 12, and a debris screen 13 covering the open top end of drain duct 14 that extends through floating roof 11. Situated partially in duct 14 is the new emergency drain assembly 15 which includes (a) an upper ball-like part 16 which is buoyant and preferably is a hollow generally spherical non-metallic element which has a sealed air space inside, and (b) a bottom plug element 17 preferably made of rubber and having a truncated conical shape. Extending upward from the top of ball-like part 16 is a guide pole 18 terminating in a top end part 19. A shank portion 20 of guide pole 18 is situated in a guide element or sleeve 21 which is supported by legs 22 above the top 11T of floating roof 11. Duct 14 extends through top and bottom surfaces 11T, 11B for overflow water to flow downward from where it is accumulated atop roof top surface 11T.

In operation emergency drain assembly 15 is designed to allow flow of accumulated water when it occurs, but to otherwise close and seal as a valve, and thus prevent upward flow and escape of vapors from liquid 12 stored in tank 10. Thus, duct 14 has at its lower part a valve seat structure 23 having conical walls dimensioned to accommodate and seal with the outer surface conical walls of plug 17 when plug 17 has descended into and in contact with valve seat 23.

As seen in FIG. 4, as accumulated water flows into duct 14 which is normally closed, the rising water will cause buoyant ball-like part 16 and its plug 17 to rise, opening said valve, and allowing the water to drain downward through duct 14, as long as water continues to occupy this duct.

As seen in FIG. 3, when there is no water or insufficient water to cause ball-like element 16 to float upward, this element descends by its weight, and plug 17 seats in conical valve seat surface 23, thus sealing this passage from any upward flow of fumes from stored liquid 12. Seating of plug 17 in valve seat 23 will occur easily and accurately because of being guided by guide pole 16 sliding axially in guide sleeve 21, as further described below.

FIGS. 2, 3 and 4 further illustrate how cylindrical sleeve guide element 21 is supported above and enclosing shank portion 20 of valve ball-like element 16 by four support legs 30 which extend downward to base ring 31 that is secured to top surface 11T of roof 11. Guide element 21 may have various forms and may be supported in other ways. As shown this guide support structure is all within screen 13.

FIGS. 3 and 4 further illustrate the debris screen or mesh 13 situated above and open top end 14T of duct 14. Leaves, dirt and other debris will usually be in the water accumulated atop roof 11, and such must be screened or filtered out before this water flows down duct 14 and through valve 15. The filter screen 13 shown in FIGS. 3 and 4 has an essentially round cylindrical shape, with its bottom edges 13B secured to the top surface 11T of roof 11. Attachment of the screen to the roof may be by bolts, glue, or other means.

FIG. 5 illustrates a floating plug emergency overflow assembly 35 generally similar to that of FIGS. 3 and 4, but further including housing 36 which includes cylindrical tubular body part 37 and top flange part 38. In this embodiment the emergency drain and valve assembly is a complete unit of housing cylinder 37, valve seal element 16, 17, valve seat 23 and flange 38 which seats against top surface 11T of the roof, this whole assembly being insertable into duct 40 in roof 11. Optionally, this assembly also includes screen 13 formed generally as a canopy covering the open top end of said housing and secured to said top and or to said flange 13B thereof.

As seen in FIGS. 3 and 4, duct 14 with valve seal 23 at the bottom forms a sump in the top surface 11T of the roof. The diameter of ball-like element 16 is slightly smaller than the diameter of duct 14 so that water flowing into duct 14 will form a layer that quickly surrounds ball-like element 16 and causes it to float upward, thus quickly opening the valve. In one embodiment there is duct diameter of about 4 inches, ball diameter of about 3 inches, sump depth of about 3 inches, and ball weight of 6-8 ounces. In this case the annular clearance between the ball's outer surface and the duct's inner wall surface is in the range of 0.5 to 0.6 inches.

In the above described preferred embodiment the valve materials are plastic for the ball, vulcanized rubber for the plug, plastic for the guide pole, plastic for the guide sleeve, stainless steel for the screen, and vulcanized rubber for the valve seat. In the embodiment of FIG. 5 the body part 37 is formed of plastic.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

The invention claimed is:

1. A floating plug emergency drain valve for a floating roof used with a storage tank for volatile fluid, where said floating roof includes vertically spaced apart top and bottom surfaces and a duct having open top and bottom ends that extends through said roof for drainage through said roof of water accumulated atop said roof, said valve having an open state for allowing said accumulated water to drain downward through said duct and a closed state for blocking vapors from rising upward through said duct, said valve comprising:

a. a valve seat mountable in said duct below said top surface of said roof, said valve seat having a generally truncated conical upper sealing surface, b. a valve sealing element having (i) a buoyant ball-like upper part, (ii) a bottom part formed as a plug extending downward with a generally truncated conical outer sealing surface conforming generally to and sealing with said valve seat upper sealing surface when said valve is in its closed state, and (iii) a guide pole extending upward from said upper part, and c. a guide member mountable to said roof to slidably receive said guide pole and to thereby guide said plug to align and seal with said valve seat when said valve is in said closed state.

2. A valve according to claim 1 further comprising a water-porous screen securable to said top surface of said roof and covering said open top of said duct to allow water accumulated on said roof to flow through said screen and downward through said duct when said valve is in its open state.

3. A valve according to claim 1, wherein said guide member is mountable to said top surface of said roof.

4. A valve according to claim 1, wherein said ball-like element is at least partially hollow with air sealed inside.

5. A valve according to claim 1, wherein said ball-like element is non-metal.

6. A valve according to claim 1, wherein said plug comprises rubber.

7. A valve according to claim 1, wherein said valve seat sealing surface comprises rubber.

8. A valve according to claim 1, wherein said screen is a non-rusting mesh sheet material.

9. A valve according to claim 1, wherein said valve seal element is generally spherical.

10. A valve according to claim 1, wherein said duct extending through said roof defines a sump having a bottom part that is sealed by said valve in its closed state.

11. A valve according to claim 1, wherein said valve seat is situated generally at the level of said bottom surface of said roof.

12. A floating plug emergency drain valve for a floating roof used with a storage tank for volatile fluid, where said floating roof includes vertically spaced apart top and bottom surfaces and a duct having open top and bottom ends that extends through said roof for drainage through said roof of water accumulated atop said roof, said valve having an open state for allowing said accumulated water to drain downward through said duct and a closed state for blocking vapors from rising upward through said duct, said valve comprising:

a. a valve seat mountable in said duct, said valve seat having an upper sealing surface situated below said top surface of said roof, and b. a valve sealing element having (i) a buoyant ball-like upper part, and (ii) a bottom part formed as a plug extending downward with a bottom sealing surface conforming generally to and sealing with said valve seat upper sealing surface when said valve is in its closed state.

13. A valve according to claim 12 where said valve further comprises a first element extending upward from said upper part of said valve sealing element, and a second element mountable to said roof to slidably receive said first element and to thereby guide said plug to align and seal with said valve seat when said valve is reaching its said closed state.

14. A floating roof usable with a storage tank for volatile fluid, comprising:

(a) a frame with vertically spaced-apart upper and lower roof panels secured to said frame, (b) a duct having open top and bottom ends that extends through said roof for drainage of water accumulated atop said roof, (c) a valve having an open state for allowing accumulated water to drain downward through said duct, and a closed state for blocking vapors from rising upward through said duct, said valve comprising:

(1) a valve seat situated in said duct, said valve seat having an upper sealing surface below said top surface of said roof, and (2) a valve sealing element having (i) a buoyant upper part, and (ii) a bottom part formed as a plug extending downward with a lower sealing surface conforming generally to and sealing with said valve seat upper sealing surface when said valve is in its closed state.

15. A method for emergency draining of water accumulated atop a floating roof used with a storage tank for volatile fluid, where said floating roof includes:

(a) vertically spaced-apart top and bottom surfaces and a duct having open top and bottom ends that extends through said roof for drainage of water accumulated atop said roof, and (b) a valve having a valve seat, with an upper sealing surface and a valve sealing element having an open state spaced from said valve seat for allowing accumulated water to drain downward through said duct, and a closed state in contact with said valve seat for blocking vapors from rising upward through said duct, said method, comprising:

(i) positioning said valve seat in said duct below said top surface of said roof, and (ii) positioning said valve sealing element in said duct having (i) a buoyant ball-like upper part, and (ii) a bottom part having a lower sealing surface conforming generally to and sealing with said valve seat upper sealing surface when said valve is in its closed state, and whereby accumulated water flowing from atop said roof into said duct to said valve in its closed state will cause said valve to open quickly after said water begins to flow into said duct.

16. A method according to claim 15 comprising the further step of forming the duct to have diameter only slighter larger that the diameter of said ball-like upper part so that water flowing into said duct will quickly surround said ball-like element and cause it to float upward, thus opening said valve.

* * * * *